US009826808B2

(12) United States Patent
Yeh et al.

(10) Patent No.: US 9,826,808 B2
(45) Date of Patent: Nov. 28, 2017

(54) HARD SIDED WHEELED CASE WITH COMPRESSION-EXPANSION

(71) Applicant: Briggs and Riley Travelware, LLC, Hauppauge, NY (US)

(72) Inventors: Herng Fuu Richard Yeh, New York, NY (US); Georgene Rada, Northport, NY (US); Alan Sticca, White Plains, NY (US)

(73) Assignee: Briggs and Riley Travelware, LLC, Hauppauge, NY (US)

( * ) Notice: Subject to any disclaimer, the term of this patent is extended or adjusted under 35 U.S.C. 154(b) by 0 days.

(21) Appl. No.: 14/795,126

(22) Filed: Jul. 9, 2015

(65) Prior Publication Data

US 2016/0366995 A1 Dec. 22, 2016

Related U.S. Application Data

(60) Provisional application No. 62/182,172, filed on Jun. 19, 2015.

(51) Int. Cl.

| | |
|---|---|
| ***A45C 13/04*** | (2006.01) |
| ***A45C 7/00*** | (2006.01) |
| ***A45C 5/03*** | (2006.01) |
| ***A45C 5/14*** | (2006.01) |
| ***A45C 5/02*** | (2006.01) |
| ***A45C 13/26*** | (2006.01) |

(52) U.S. Cl.

CPC ..... *A45C 7/0022* (2013.01); *A45C 5/02* (2013.01); *A45C 5/03* (2013.01); *A45C 5/14* (2013.01); *A45C 7/0031* (2013.01); *A45C 13/262* (2013.01); *A45C 2005/037* (2013.01); *A45C 2013/267* (2013.01)

(58) Field of Classification Search

CPC .. A45C 13/04; A45C 7/0022; A45C 2005/037
USPC ..... 190/103–105, 122, 127, 24
See application file for complete search history.

(56) References Cited

U.S. PATENT DOCUMENTS 281,268 A 7/1883 Haskell
287,473 A 10/1883 Reetz
(Continued)

FOREIGN PATENT DOCUMENTS

CN 1830352 A 4/2006
CN 201197447 Y 2/2009
(Continued)

OTHER PUBLICATIONS

European Search Report dated Jun. 10, 2015 corresponding to EP 12844818.0.
(Continued)

*Primary Examiner* — Sue A Weaver
(74) *Attorney, Agent, or Firm* — Scully Scott Murphy and Presser

(57) ABSTRACT

An embodiment of an article of luggage is disclosed, the luggage in one practice having compression and expansion capability comprising an interposed metal frame of split configuration having an expansion portion positioned between the split where the metal frame is attached to one side of the luggage. One of more expansion and locking devices permit compression of contents and also enables locking the luggage in its expanded shape.

16 Claims, 8 Drawing Sheets

(56) References Cited

U.S. PATENT DOCUMENTS

| | | | | |
|---|---|---|---|---|
| 440,278 | A | 11/1890 | Payntar | |
| 615,552 | A | 12/1898 | Hicks | |
| 664,043 | A | 12/1900 | Holman | |
| 712,762 | A | 11/1902 | Bukoutz | |
| 764,144 | A | 7/1904 | McGowan | |
| 1,705,526 | A | 3/1929 | Kennedy | |
| 4,854,430 | A * | 8/1989 | Peterson | A45C 7/0022 190/105 |
| 4,953,673 | A * | 9/1990 | Ambasz | A45C 7/0022 190/103 |
| 5,671,831 | A * | 9/1997 | Chiu | A45C 5/14 190/103 |
| 6,234,287 | B1 * | 5/2001 | Pfeiffer | A45C 7/005 150/105 |
| 6,390,259 | B1 | 5/2002 | Lu | |
| 6,408,997 | B1 | 6/2002 | Chen | |
| 6,533,087 | B1 | 3/2003 | Chen | |
| 6,672,439 | B2 * | 1/2004 | Platte, III | A45C 3/02 190/103 |
| 2002/0185350 | A1 | 12/2002 | Cheng | |
| 2004/0262111 | A1 | 12/2004 | Ghiassi | |
| 2005/0051404 | A1 * | 3/2005 | Chi | A45C 7/0036 190/107 |
| 2005/0067244 | A1 | 3/2005 | Smith | |
| 2006/0070837 | A1 | 4/2006 | King | |
| 2006/0196743 | A1 * | 9/2006 | Lin | A45C 5/14 190/18 A |
| 2007/0045072 | A1 * | 3/2007 | Selvi | A45C 5/03 190/103 |
| 2007/0151820 | A1 | 7/2007 | Lin | |
| 2007/0209894 | A1 | 9/2007 | Selvi | |
| 2009/0166138 | A1 | 7/2009 | Gorga | |
| 2011/0048881 | A1 | 3/2011 | Wang | |
| 2012/0175207 | A1 * | 7/2012 | Scicluna | A45C 7/0022 190/107 |
| 2013/0092490 | A1 * | 4/2013 | Moon | A45C 7/0031 190/18 A |
| 2013/0140118 | A1 | 6/2013 | Benshetrit et al. | |
| 2015/0250277 | A1 | 9/2015 | Tsui | |

FOREIGN PATENT DOCUMENTS

| | | | |
|---|---|---|---|
| CN | 203388397 | U | 1/2014 |
| CN | 104055295 | A | 9/2014 |
| EP | 1649772 | A2 | 4/2006 |
| EP | 2428131 | A1 | 3/2012 |
| EP | 2476337 | A2 | 7/2012 |
| GB | 2407560 | A | 5/2005 |
| JP | 2008-515571 | A | 5/2008 |
| JP | 3176684 | A | 6/2012 |
| JP | 2012-143565 | A | 8/2012 |
| JP | 2015-036091 | A | 2/2015 |
| JP | 2015-54128 | A | 3/2015 |
| TW | 101201849 | | 2/2012 |
| WO | 2006039725 | A2 | 4/2006 |
| WO | WO2006039725 | A2 | 4/2006 |
| WO | WO2007079412 | A2 | 7/2007 |
| WO | 2013067470 | A1 | 5/2013 |

OTHER PUBLICATIONS

Chinese Office Action dated Apr. 23, 2015 corresponding to CN 201280053342.9.

International Search Report and Written Opinion dated Feb. 14, 2013 issued in PCT/US2012/063474.

Extended European Search Report dated Dec. 2, 2015 from related European Application No. 15177858.6.

Canadian Office Action dated May 11, 2016 corresponding to Canadian Patent Appln. No. 2,897,633, filed Jul. 14, 2015.

Notification of Reason(s) for Refusal issued in Patent Application No. 2015-144369 dated Nov. 1, 2016 (in English and Japanese).

Office Action issued in Canadian Patent Application No. 2,897,633 dated Feb. 21, 2017.

First Office Action issued in Chinese Patent Application No. 201510567964.9 dated Oct. 28, 2016 (in English and Chinese).

Notification of Reason(s) for Refusal dated Jun. 27, 2017 issued in Japanese Patent Application No. 2015-144369 (in English and Japanese).

* cited by examiner

FIG. 6
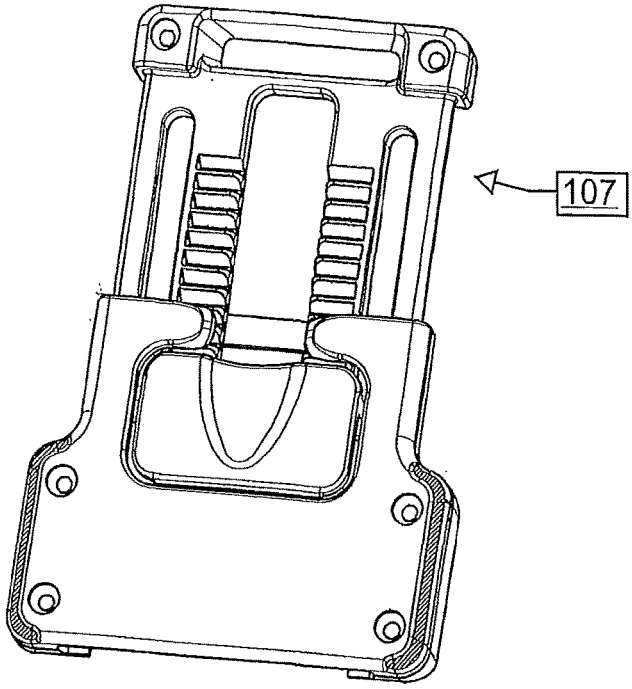
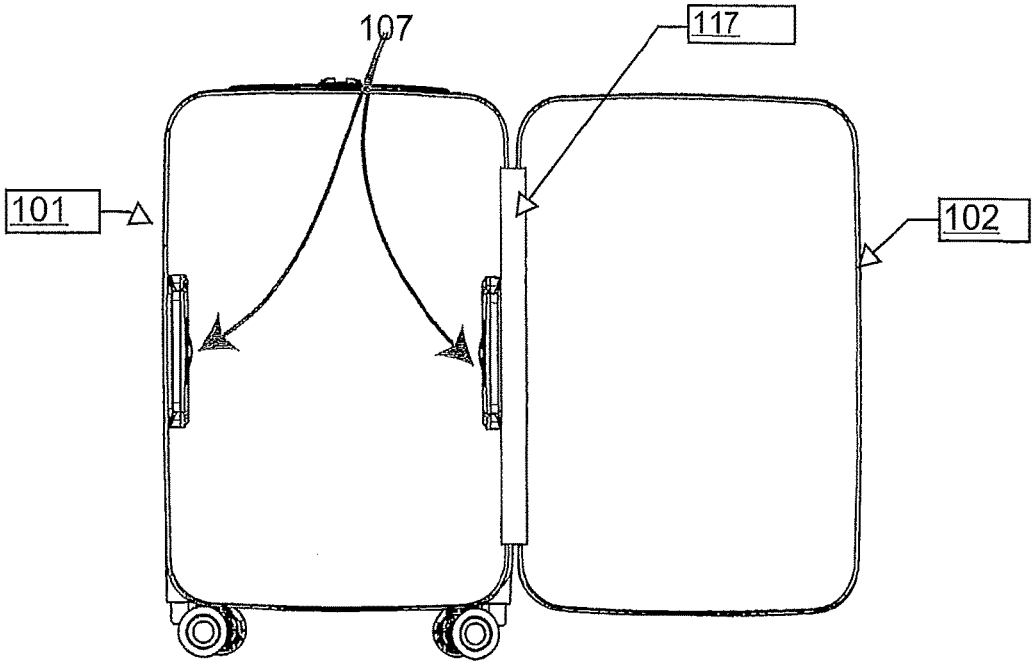
FIG. 7

HARD SIDED WHEELED CASE WITH COMPRESSION-EXPANSION

CROSS REFERENCE TO RELATED APPLICATIONS

This application claims benefit of to the following U.S. Patent Application: U.S. Patent Application Ser. No. 62/182,172, filed Jun. 19, 2015, the entire contents of which is incorporated herein by reference.

FIELD OF THE INVENTION

The disclosure relates to wheeled luggage of expandable construct permitting a user to selectively increase or decrease the capacity of the luggage. The wheeled features are designed to allow the user to freely move the luggage in a standing position, and to spin the luggage over one or more predetermined axes, including conveniently around its vertical axis when the luggage is upright.

BACKGROUND OF THE INVENTION

Hitherto, expandable luggage has been typified by zippered sections that, when unzipped, permits the luggage to be expanded by, for example, gussets and the like. Other practices involve complicated expansion mechanisms which let the luggage expand but do not lock or otherwise secure so as to maintain the expanded shape. Moreover, hard-sided luggage, in particular, because of inflexibility due to the rigidness of materials of construction, has been problematic for successful implementation of compression-expansion practices, thus leaving a need in this style of luggage.

SUMMARY OF THE INVENTION

In one aspect, the invention is an article of luggage having compression-expansion capability comprising a main body, the main body comprised of first and second shells, preferably hard sided first and second shells, that are operably connected, e.g. pivotably connected, to form a storage cavity or cavities when closed; a split metal frame interposed between the first and second shells and connected to the first shell, the split metal frame having an expansion portion positioned between the split; at least one expansion and locking device disposed within the first shell and configured to allow free movement of the expansion portion in a compression direction toward the first shell, and configured to enable locking of the expansion portion in an expanding direction away from the first shell; and at least one handle, e.g. an extendable handle, attached to the main body. The luggage may further comprise a plurality of wheels attached to each of the first and second shells, e.g. at the bottoms thereof. Optionally, the wheels are able to spin about the vertical axis of the main body when the main body is in an upright position.

BRIEF DESCRIPTION OF THE DRAWINGS

FIG. 6 is a frontal view of an embodiment of an expansion and locking device useful in the invention.

FIG. 7 is a plan view of an embodiment of a piece of luggage in accordance with the invention, opened.

DETAILED DESCRIPTION OF THE INVENTION

The entire contents of the following applications are incorporated by reference herein: U.S. Patent Application Publication No. 2013/0140119 and U.S. Patent Application Publication No. 2014/0353103. The invention in one embodiment is an article of luggage having compression-expansion capability, the article of luggage comprising a main body, which main body can be comprised of two or more shells; the following description as depicted in FIGS. 1A, 1B, 2A, 2B, and 3A-C, exemplify a preferred practice wherein the main body 100 comprises a first shell 101 and a second shell 102. The first and second shells can be identical or they can be different from one another in size and/or shape and/or capacity. The first and second shells can each independently be comprised of the same or different materials of construction; without limitation, materials of construction in this regard include fabric, plastic, metal, fiberglass, or combinations thereof. In a preferred practice, the article of luggage is hard sided, e.g. the first and second shells are at least partly comprised, preferably substantially comprised, and more preferably fully comprised of rigid or semi-rigid materials of construction such as plastics, metals, fiberglasses, rubbers, or combinations thereof. Plastic materials can include thermoplastics such as polycarbonates (PC), acrylonitrile butadiene styrene (ABS), polypropylene (PP), and combinations thereof; exemplary metals include aluminum, an aluminum alloy, and combinations thereof.

Figure 4:
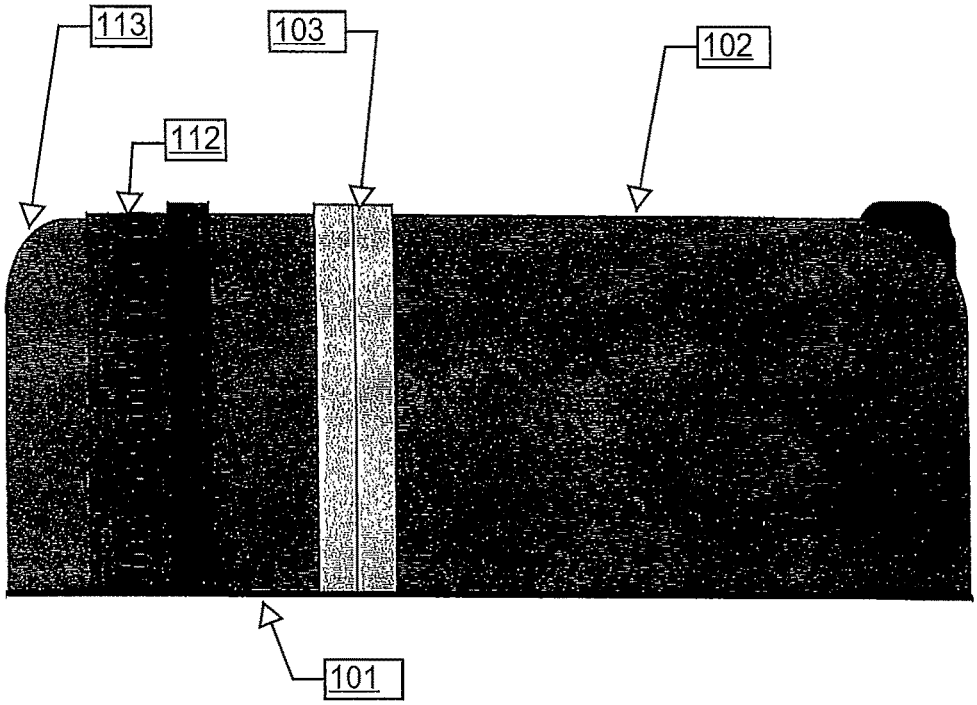
FIG. 4 is a partial side detail view of an embodiment of the invention.

In one practice, the first and second shell can each optionally further comprise one or more outer compartments 113 accessed by zippers, lids, and the like, 112. In one practice, FIG. 4, a zipper 112 provides access to compartment 113 the surface of which can be fabric, plastic, metal as herein described. The first and second shells are operably connected, e.g. pivotably connected, FIG. 2A, 108*a*, by means known in the art, including without limitation by hinge, zipper, latch, and the like, to form a storage cavity, which term includes multiple storage cavities, when the shells are closed.

Interposed between the first shell 101 and the second shell 102 is at least one split metal frame 103 which comprises at least frame portions 103*a* and 103*b*, each of which frame portions can be independently comprised of metals known in the art and suitable for the purpose, e.g. light weight, mechanically strong, rust proof metals, including preferably without limitation, aluminum and aluminum alloys. In one practice, the split metal frame 103 is connected to the first shell 101. Split metal frame 103 has an expansion portion 104 positioned between the split, e.g. interposed between frame portions 103*a* and 103*b*. The expansion portion 104 comprises materials of construction known in the art, including without limitation: fabrics, synthetic polymers, or combinations thereof. A preferred polymer is nylon, more preferably high tenacity ballistic nylon.

Figure 5A:
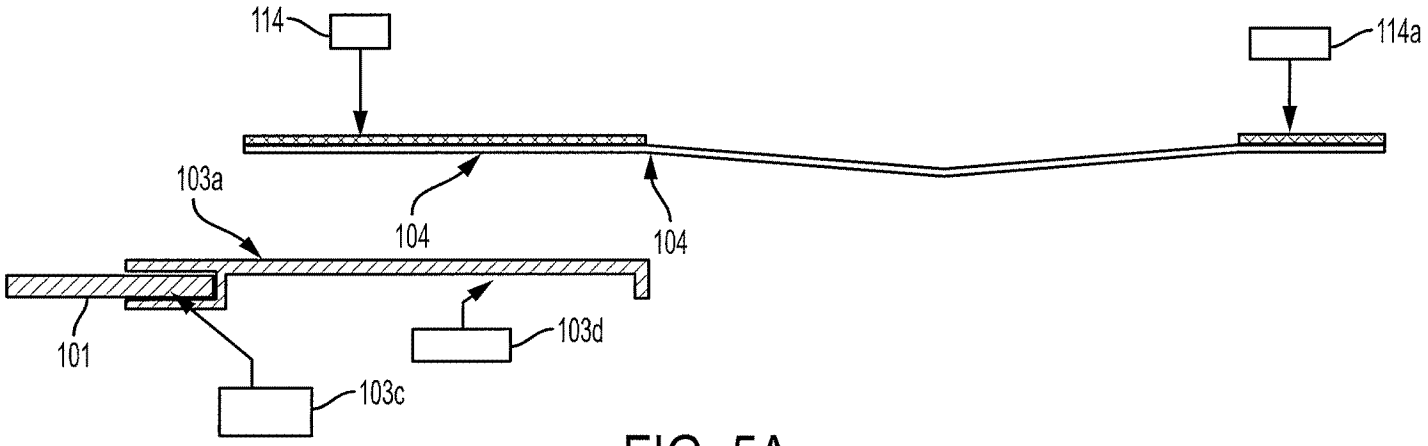
FIG. 5A is a side exploded view detail of an embodiment of a split metal frame of the invention.
Figure 5B:
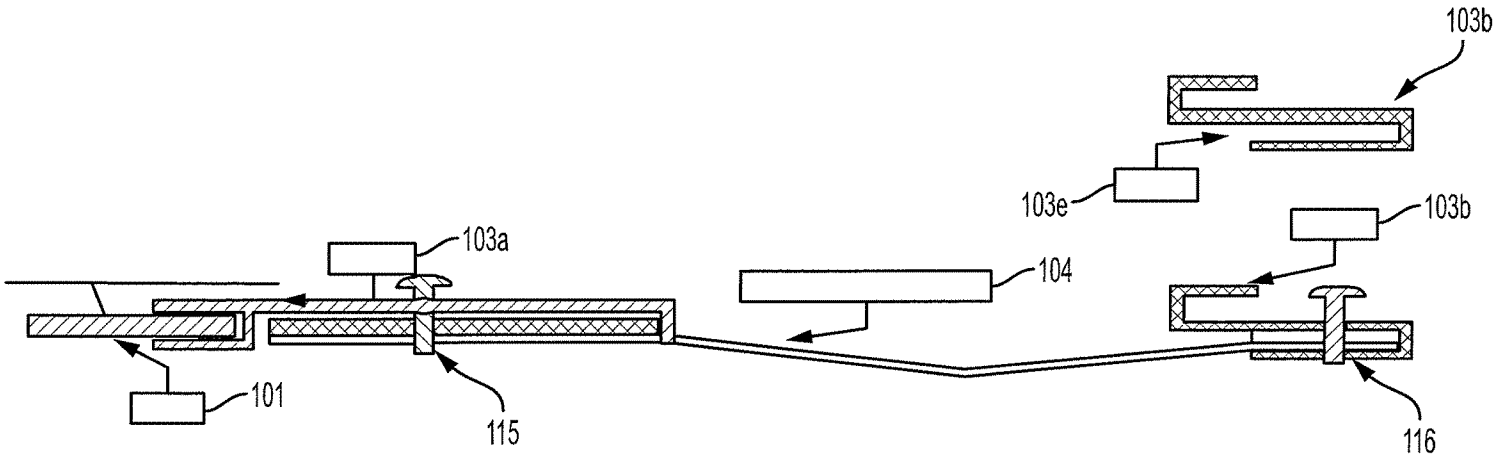
FIG. 5B is a side view detail of the embodiment of FIG. 5A assembled.
Figure 8A:
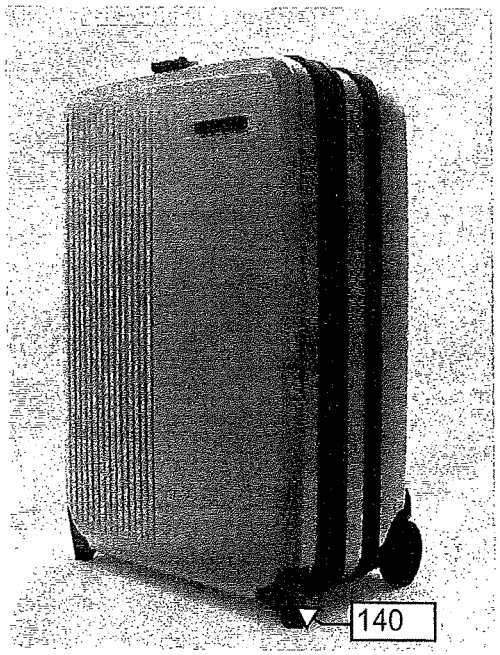
FIG. 8A is a frontal view of an embodiment of the invention
Figure 8B:
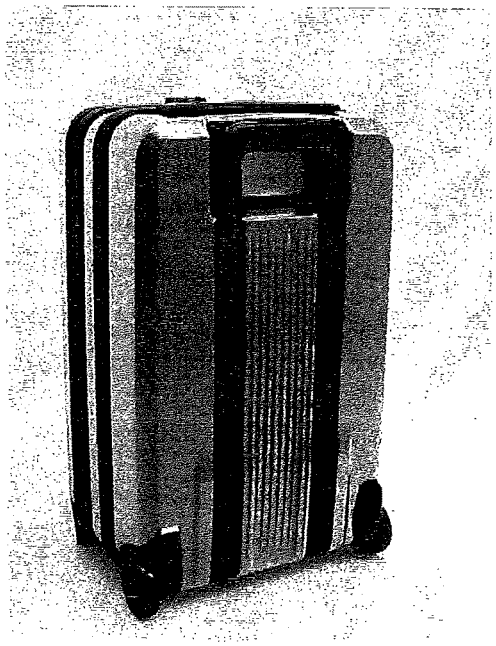
FIG. 8B. is a rear view of an embodiment of the invention.
Figure 9:
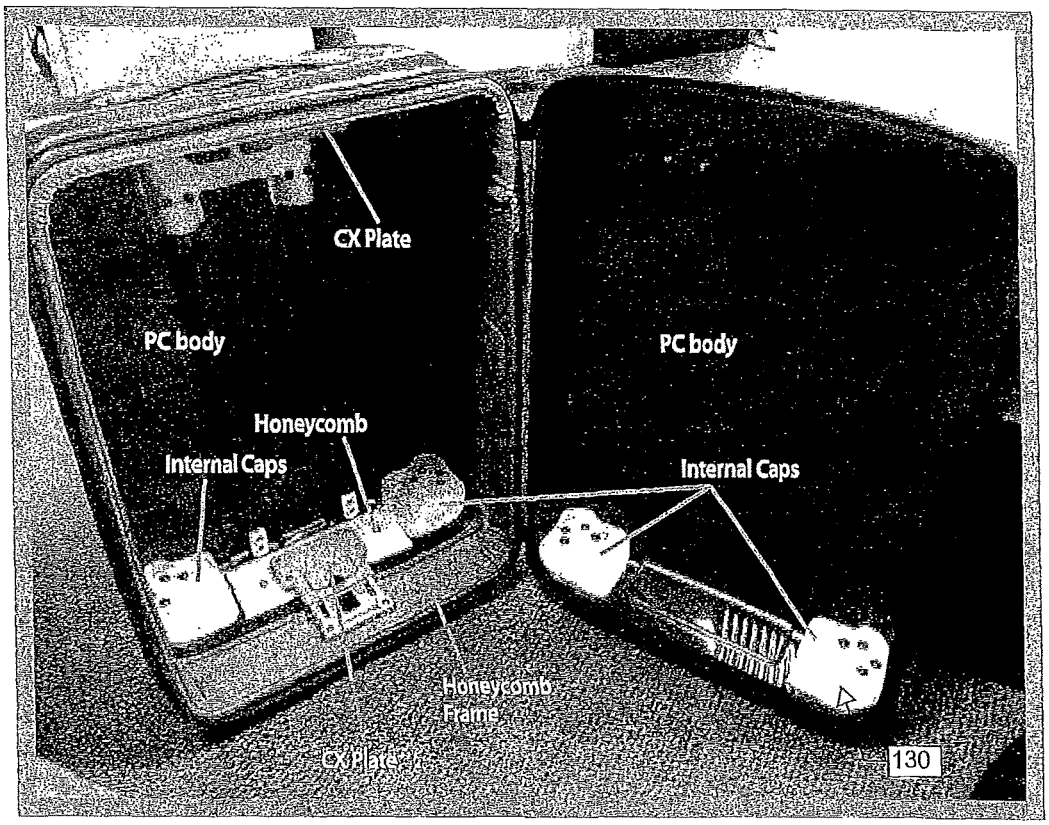
FIG. 9 is a partial view of an embodiment of the invention.

FIG. 5A shows a practice for securing the expansion portion 104 to the split metal frame portions 103*a* and 103*b* which is attached to shell 101. In the embodiment shown, shell 101 fits into slot 103*c* of frame portion 103*a*. Expansion portion 104 has its ends in contact with, or optionally secured, to board sections 114 and 114*a*, which board sections can be plastic, e.g. polyethylene or polypropylene; these are fitted into slot 103*d* of frame portion 103*a*, and slot 103*e* of frame portion 103*b*. These are then secured by means known in the art, e.g. screws 115, 116, or rivets and the like. In a preferred practice, the ratio of the depth of the first shell, as measured from its outer surface, to the expansion portion when fully extended, is up to about 2:1, preferably up to about 1.5:1.

Figure 1B:
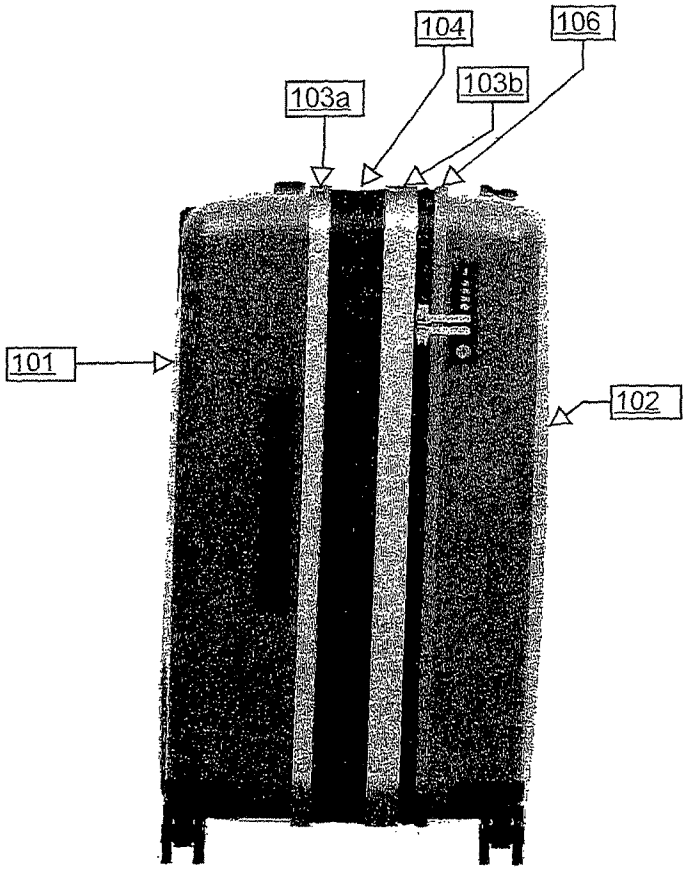
FIG. 1B is a side view of the embodiment of FIG. 1A showing the luggage expanded.
Figure 1A:
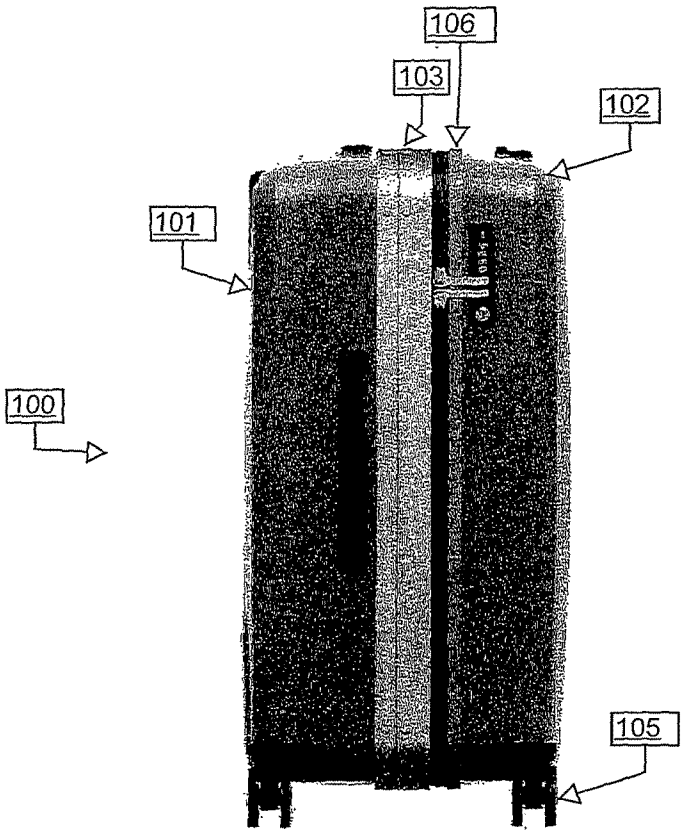
FIG. 1A is a side view of an embodiment of the invention showing the luggage upright and unexpanded.
Figure 2A:
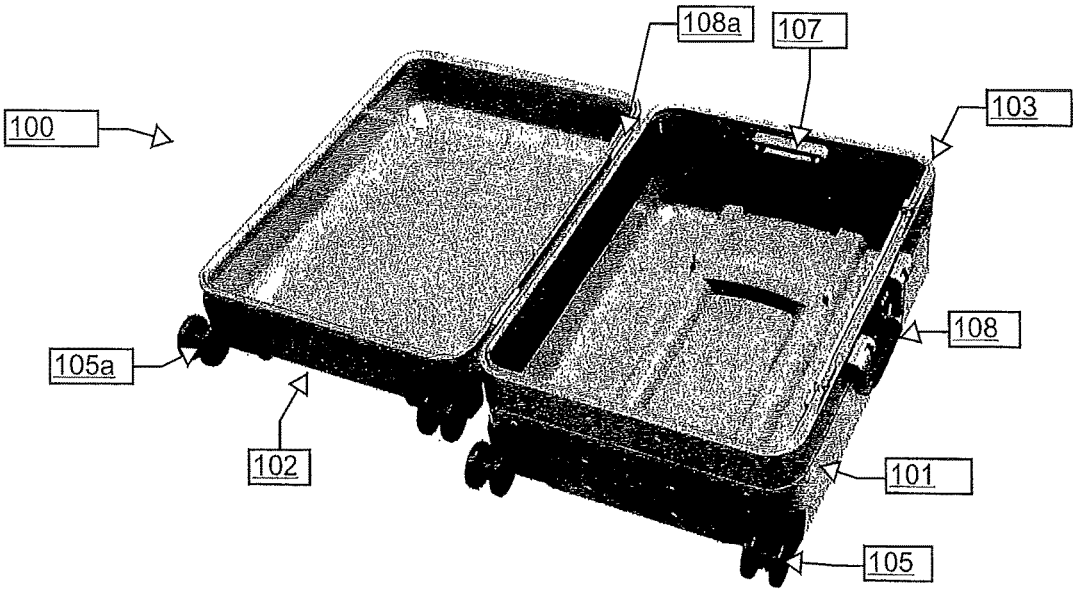
FIG. 2A is a perspective view of an embodiment of the invention showing the luggage opened and unexpanded.
Figure 2B:
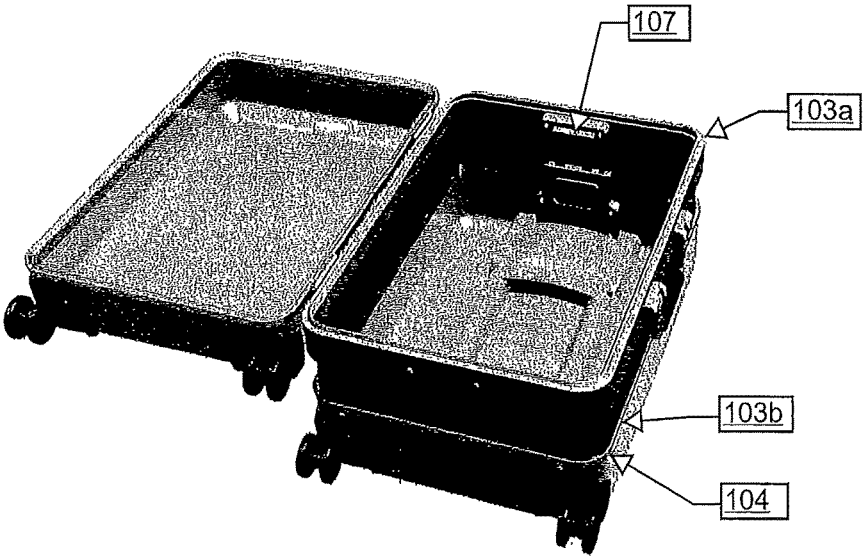
FIG. 2B is a perspective view of the embodiment of FIG. 2A showing the luggage opened and expanded.
Figure 3A:
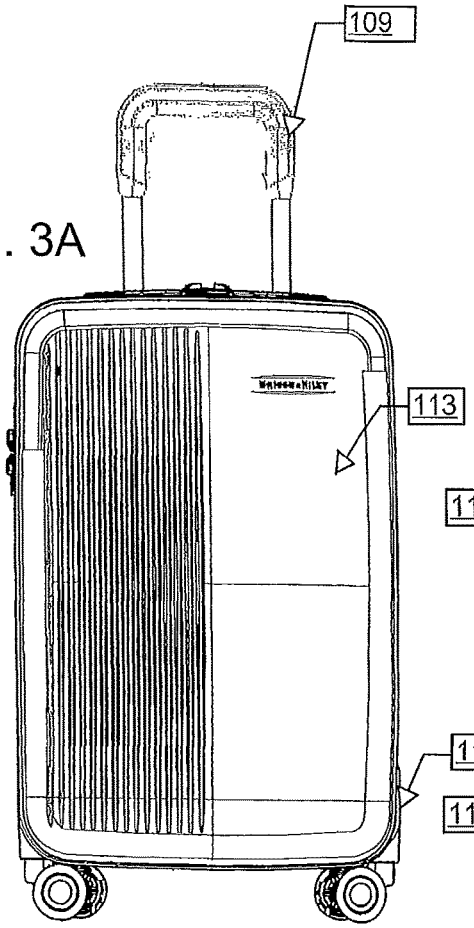
FIG. 3A is frontal view of an embodiment of the invention.
Figure 3B:
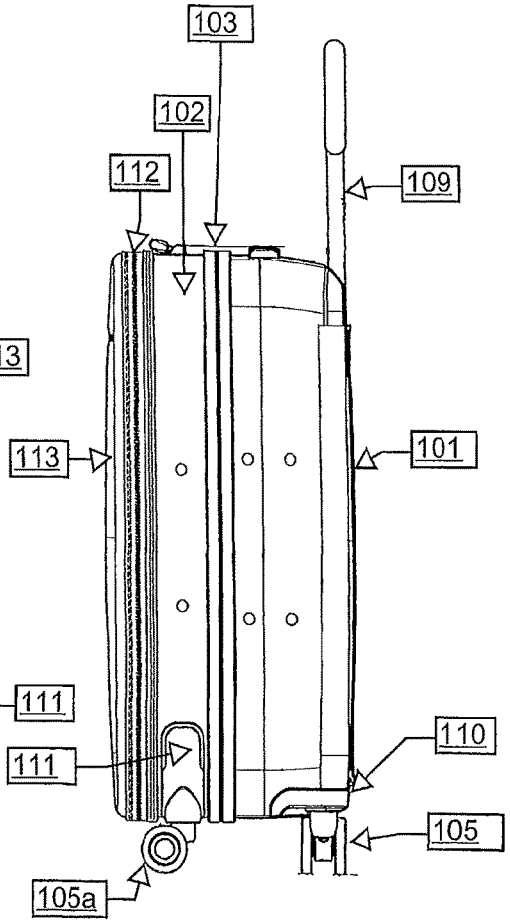
FIG. 3B is a side view of the embodiment of FIG. 3A.
Figure 3C:
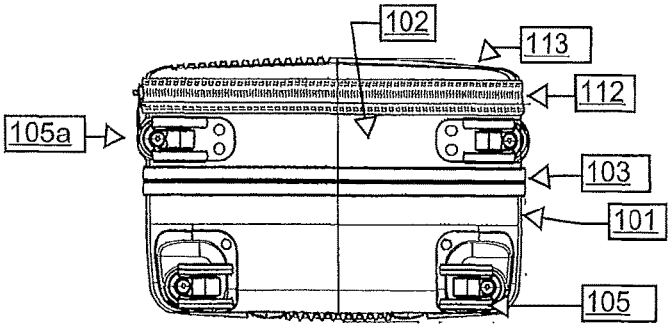
FIG. 3C is a bottom view of the embodiment of FIG. 3A.

The luggage article as herein described further comprises at least one expansion and locking device disposed within the first shell and configured to allow free movement of the expansion portion in a compression direction toward the first shell, and configured to enable locking of the expansion portion in an expanding direction away from the first shell. A preferred expansion and locking mechanism is a ratchet-type device 107 as depicted in FIG. 6, as described in U.S. Patent Application Publication No. 2013/0140119 and U.S. Patent Application Publication No. 2014/0353103, the entire contents of which are incorporated herein by reference. Preferably, as shown in FIG. 7, at least two expansion and locking mechanisms 107, which can be the same or different, are disposed on substantially opposite, internal sides of the first shell 101; a flap or lining 117 can optionally be incorporated to cover seams, bindings and other mechanical aspects. Locking mechanisms 107 can be attached to the internal walls of shell 101 by means known in the art, e.g. rivets, screws, bolts and the like. At least one handle is attached to the main body. FIG. 2A shows carrying handle 108; FIG. 3 shows extendable handle 109; extendable handle 109 can be mounted on either the outside or inside of the main body; preferably, it s mounted to be substantially flush with the outside surface of the main body.

In one practice the article of luggage may have wheels 105, 105*a*, e.g. a plurality of wheels attached to each of the first and second shells, e.g. at the bottom thereof; preferably one or more of the wheels are designed to be able to spin about the vertical axis of the main body when the luggage is in an upright position thus making the luggage easily steerable in all directions. The wheels may be of design known in the art, e.g. casters, pairs, fixed (i.e. non-pivoting) wheels and the like. Sets of wheels, e.g. 105 and 105*a*, may be the same of different. The wheels are preferably secured inside or outside the main body with internal caps 130. In one practice the article of luggage may have two or more feet 140 attached to the first and second shells, e.g. at the bottom thereof to provide stability when the article of luggage is upright and has only two wheels.

The embodiments of the foregoing description are not limitative of the invention.

What is claimed is:

1. An article of luggage having compression-expansion capability comprising:

a main body comprising a first shell and a second shell which are operably connected to form a storage cavity when closed;

a split frame connected to the first shell and the second shell, the split frame comprising:

a first split portion connected to a lower edge of the first shell;

a second split portion connected to an upper edge of the second shell, wherein the lower edge and the upper edge face each other when the first shell and the second shell are operably connected; and an expansion portion interposed between the first split portion and the second split portion, wherein the expansion portion is configured to be expansible between a first end of the expansion portion and a second end of the expansion portion, wherein the expansion portion comprises a first board section connected to the first end and a second board section connected to the second end, wherein the first split portion comprises:

a first shell receiving slot configured to at east partially receive the lower edge of the first shell;

a first board receiving slot configured to at least partially receive the first board section; and a first fastener extending through the first board section, the first end and the first split portion to fix the first board section and the first end to the first split portion, after the first board section is at least partially received in the first board receiving slot; and at least one expansion and locking device configured to allow free movement of the expansion portion in a compression direction toward the first shell, and configured to enable locking of the expansion portion in an expanding direction away from the first shell.

2. The article of luggage of claim 1 further comprising a plurality of wheels attached to each of the first and second shells.

3. The article of luggage of claim 2 wherein the wheels are able to spin about the vertical axis of the main body when the main body is in an upright position.

4. The article of luggage of claim 3 having two expansion and locking devices, which can be the same or different, disposed on opposite sides within the first shell.

5. The article of luggage of claim 1 further comprising a handle that is an extendable handle.

6. The article of luggage of claim 5 wherein the extendable handle is mounted on either the outside or inside of the main body.

7. The article of luggage of claim 1 wherein the first shell and the second shell are each independently made of fabric, plastic, metal, fiberglass, or combinations thereof.

8. The article of luggage of claim 7 wherein the plastic is selected from polycarbonate (PC), acrylonitrile butadiene stryrene (ABS), polypropylene (PP), and combinations thereof; and the metal is selected from aluminum, an aluminum alloy, and combinations thereof.

9. The article of luggage of claim 1 wherein the split frame is comprised of aluminum, and aluminum alloy or combinations thereof.

10. The article of luggage of claim 1 wherein the expansion portion is comprised of fabric, synthetic polymer, or combinations thereof.

11. The article of luggage of claim 1 wherein the expansion portion is comprised of high tenacity ballistic nylon.

12. The article of luggage of claim 1, wherein the second split portion comprises:

a second shell receiving slot configured to at least partially receive the upper edge of the second shell;

a second board receiving slot configured to at least partially receive the second board section; and a second fastener extending through the second board section, the second end and the second split portion to fix the second board section and the second end to the second split portion, after the second board section is at least partially received in the second board receiving slot.

13. An article of hard-sided luggage having compression-expansion capability comprising:

a main body comprising a first shell and a second shell, wherein the first shell and the second shell are operably connected to form a storage cavity when closed;

a split frame connected to the first shell and the second shell, the split frame comprising:

a first split portion connected to a lower edge of the first shell;

a second split portion connected to an upper edge of the second shell, wherein the lower edge and the upper edge face each other when the first shell and the second shell are operably connected; and an expansion portion interposed between the first split portion and the second split portion, wherein the expansion portion is configured to be expansible between a first end of the expansion portion and a second end of the expansion portion, wherein the expansion portion comprises a first board section connected to the first end and a second board section connected to the second end, wherein the first split portion comprises:

a first shell receiving slot configured to at least partially receive the lower edge of the first shell;

a first board receiving slot configured to at least partially receive the first board section; and a first fastener extending through the first board section, the first end and the first split portion to fix the first board section and the first end to the first split portion, after the first board section is at least partially received in the first board receiving slot; and two expansion and locking devices disposed within and on opposite sides of the first shell, the expansion and locking devices configured to allow free movement of the expansion portion in a compression direction toward the first shell, and configured to enable locking of the expansion portion in an expanding direction away from the first shell;

an extendable handle attached to the main body and substantially flush with the outside surface of the main body; and a plurality of wheels attached to each of the first and second shells, wherein the wheels are able to spin about the vertical axis of the main body when the main body is in an upright position.

14. The article of luggage of claim 13 wherein the first and second shells are each independently comprised of plastic selected from polycarbonate (PC), acrylonitrile butadiene stryrene (ABS), polypropylene (PP), and combinations thereof; the split frame is selected from aluminum, an aluminum alloy, and combinations thereof; and the expansion portion is comprised of fabric, synthetic polymer, or combinations thereof.

15. The article of luggage of claim 14 wherein the expansion portion is comprised of nylon.

16. The article of luggage of claim 13, wherein the second split portion comprises:

a second shell receiving slot configured to at least partially receive the upper edge of the second shell;

a second board receiving slot configured to at least partially receive the second board section; and a second fastener extending through the second board section, the second end and the second split portion to fix the second board section and the second end to the second split portion, after the second board section is at least partially received in the second board receiving slot.

* * * * *